US009638392B2

(12) United States Patent
Rice et al.

(10) Patent No.: US 9,638,392 B2
(45) Date of Patent: May 2, 2017

(54) LAMP OPTIC FOR USE IN LED-BASED LAMP

(71) Applicants: Lawrence M. Rice, Hillsboro, NH (US); Ronald E. Boyd, Jr., Chichester, NH (US); Thomas Tessnow, Weare, NH (US); Howard Eng, Hancock, NH (US)

(72) Inventors: Lawrence M. Rice, Hillsboro, NH (US); Ronald E. Boyd, Jr., Chichester, NH (US); Thomas Tessnow, Weare, NH (US); Howard Eng, Hancock, NH (US)

(73) Assignee: OSRAM SYLVANIA Inc., Wilmington, MA (US)

( * ) Notice: Subject to any disclaimer, the term of this patent is extended or adjusted under 35 U.S.C. 154(b) by 97 days.

(21) Appl. No.: 14/865,953

(22) Filed: Sep. 25, 2015

(65) Prior Publication Data

US 2017/0089542 A1 Mar. 30, 2017

(51) Int. Cl.
*F21V 5/00* (2015.01)
*F21V 5/04* (2006.01)

(52) U.S. Cl.
CPC ..... *F21V 5/04* (2013.01); *F21V 5/043* (2013.01); *F21V 5/046* (2013.01)

(58) Field of Classification Search
CPC . F21V 5/04; F21V 5/043; F21V 5/046; F21V 17/00
USPC ..... 362/326, 332, 317, 244, 311.01, 311.06, 362/311.09, 311.02; 257/98, 341
See application file for complete search history.

(56) References Cited

U.S. PATENT DOCUMENTS

| | | | |
|---|---|---|---|
| 5,806,965 | A | 9/1998 | Deese |
| 6,252,350 | B1 | 6/2001 | Alvarez |
| 6,342,762 | B1 | 1/2002 | Young et al. |
| 6,598,996 | B1 | 7/2003 | Lodhie |
| 6,598,998 | B2 | 7/2003 | West et al. |
| 6,679,621 | B2 | 1/2004 | West et al. |
| 6,796,698 | B2 | 9/2004 | Sommers et al. |
| 6,803,607 | B1 | 10/2004 | Chan et al. |
| 6,837,605 | B2 | 1/2005 | Reill |
| 7,021,797 | B2 | 4/2006 | Minano et al. |
| 7,086,767 | B2 | 8/2006 | Sidwell et al. |

(Continued)

FOREIGN PATENT DOCUMENTS

| | | | |
|---|---|---|---|
| WO | 2010079436 | A1 | 7/2010 |
| WO | 2014074842 | A1 | 5/2014 |

*Primary Examiner* — Anh Mai
*Assistant Examiner* — Glenn Zimmerman
(74) *Attorney, Agent, or Firm* — Edward S. Podszus

(57) ABSTRACT

A lamp optic (100) for a lamp includes a proximal end (104), a distal end (106) and a longitudinal axis (L). The proximal end (104) has a proximal inner side wall (112) linearly extending toward the distal end (106) and intersecting a proximal flat portion (114). The distal end (106) has a distal inner side wall (120) linearly extending toward the proximal end (104) and intersecting a distal flat portion (122). The distal flat portion length (LD) is at least 25 percent of the proximal flat portion length (LP). A lateral side (108) extends from the proximal end (104) to the distal end (106). The lateral side (108) has a first skirt region (124) and a second skirt region (126). The first skirt region (124) and the second skirt region (126) extend linearly and successively from the proximal end (104) to the distal end (106).

17 Claims, 6 Drawing Sheets

(56) References Cited

U.S. PATENT DOCUMENTS

| | | | | |
|---|---|---|---|---|
| 7,111,972 | B2 | 9/2006 | Coushaine et al. | |
| 7,261,437 | B2 | 8/2007 | Coushaine et al. | |
| 7,474,474 | B2 | 1/2009 | Angelini et al. | |
| 8,021,028 | B2 | 9/2011 | Riesebosch | |
| 8,297,799 | B2 | 10/2012 | Chou | |
| 8,585,274 | B2 | 11/2013 | Householder | |
| 8,864,346 | B2 * | 10/2014 | Chinniah | F21V 7/0091 362/311.02 |
| 9,028,100 | B2 * | 5/2015 | Li | F21V 5/04 362/277 |
| 2005/0225988 | A1 | 10/2005 | Chaves et al. | |
| 2011/0194295 | A1 | 8/2011 | Householder et al. | |
| 2014/0198500 | A1 | 7/2014 | Tessnow et al. | |
| 2014/0334179 | A1 | 11/2014 | Coleiny | |
| 2015/0276179 | A1 * | 10/2015 | Hu | F21V 7/0025 362/305 |

* cited by examiner

LAMP OPTIC FOR USE IN LED-BASED LAMP

TECHNICAL FIELD

The present disclosure relates to lamps and, in particular, to a lamp optic for a lamp including at least one light emitting diode (LED).

BACKGROUND

In recent years, light-emitting-diodes (LED(s)) have emerged as a new technology for illumination and lighting applications. LED(s) have potential advantages over fluorescent lamps in that they may be more efficient, may produce less heat, may have longer lifetimes, and may function more efficiently at cold temperatures. For these reasons and others, there has been a recent effort to incorporate LED(s) into lighting applications.

Examples of known LED-based lamps are discussed in U.S. Pat. No. 8,297,799 (Chou); U.S. Pat. No. 6,803,607 (Chan et al.); U.S. Pat. No. 8,585,274 (Householder et al.); U.S. Pat. No. 7,021,797 (Minano et al.); U.S. Patent Application Publication No. 2005/0225988 (Chaves et al); PCT Patent Application Publication No. WO 2010/079436 (Bonnekamp et al); U.S. Pat. No. 7,275,849 (Chinniah et al.); and U.S. Pat. No. 6,796,698 (Sommers et al.).

SUMMARY

An exemplary embodiment of a lamp optic includes a proximal end, a distal end and a longitudinal axis extending from the proximal end to the distal end. The proximal end of the lamp optic is configured to receive light from at least one light emitting diode. The proximal end has a proximal inner side wall linearly extending toward the distal end and intersecting a proximal flat portion. The proximal flat portion of the lamp optic extends transverse to the longitudinal axis and has a proximal flat portion length in a plane perpendicular to a plane bisecting the lamp optic and including the longitudinal axis. The proximal flat portion length is measured from the proximal inner side wall on a first side of the longitudinal axis to the proximal inner side wall on an opposite side of the longitudinal axis. The distal end of the lamp optic has a distal inner side wall linearly extending toward the proximal end and intersecting a distal flat portion. The distal flat portion of the lamp optic extends transverse to the longitudinal axis. The distal flat portion of the lamp optic has a distal flat portion length in the plane perpendicular to a plane bisecting the lamp optic and including the longitudinal axis. The distal flat portion length is measured from the distal inner side wall on a first side of the longitudinal axis to the distal inner side wall on an opposite side of the longitudinal axis. The distal flat portion length is at least 25 percent of the proximal flat portion length. The lamp optic includes a lateral side extending from the proximal end of the lamp optic to the distal end of the lamp optic. The lateral side of the lamp optic has a first skirt region and a second skirt region. The first skirt region and the second skirt region of the lamp optic extend linearly and successively from the proximal end of the lamp optic to the distal end of the lamp optic.

The lamp optic is configured to receive a first portion of light from the at least one light emitting diode through the proximal inner side wall of the proximal end and emit the first portion of the light from the first skirt region of the lateral side. The lamp optic is configured to receive a second portion of the light from the at least one light emitting diode through the proximal flat portion of the proximal end, guide the second portion of the light to be reflected by the distal inner side wall of the distal end and emit the second portion of the light from the second skirt region of the lateral side. The lamp optic is configured to receive a third portion of the light from the at least one light emitting diode through the proximal flat portion of the proximal end and emit the third portion of the light from the distal flat portion of the distal end.

This overview is intended to provide an overview of subject matter of the present patent application. It is not intended to provide an exclusive or exhaustive explanation of the subject matter. The detailed description is included to provide further information about the present patent application.

BRIEF DESCRIPTION OF THE DRAWINGS

The foregoing and other objects, features and advantages disclosed herein will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION OF PREFERRED EMBODIMENTS INCLUDING BEST MODE

In the following description, for purposes of explanation, numerous specific details are set forth in order to provide a thorough understanding of the present disclosure. It may be evident, however, to one skilled in the art, that the subject matter of the present disclosure may be practiced without these specific details.

Figure 1:
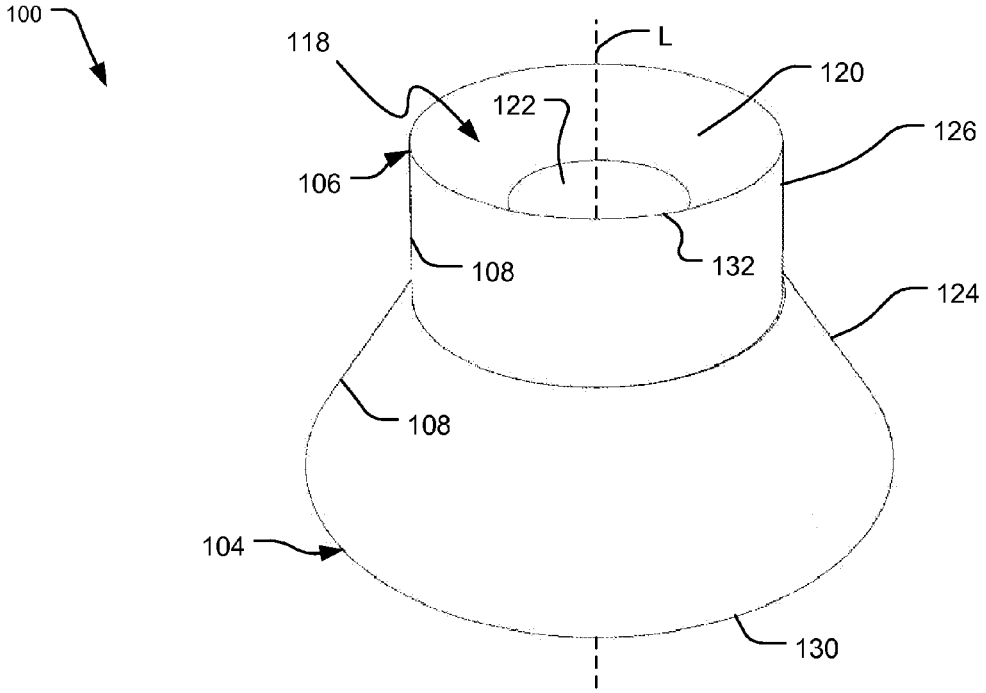
FIG. 1 is a top perspective drawing of a lamp optic according to an example embodiment.
Figure 2:
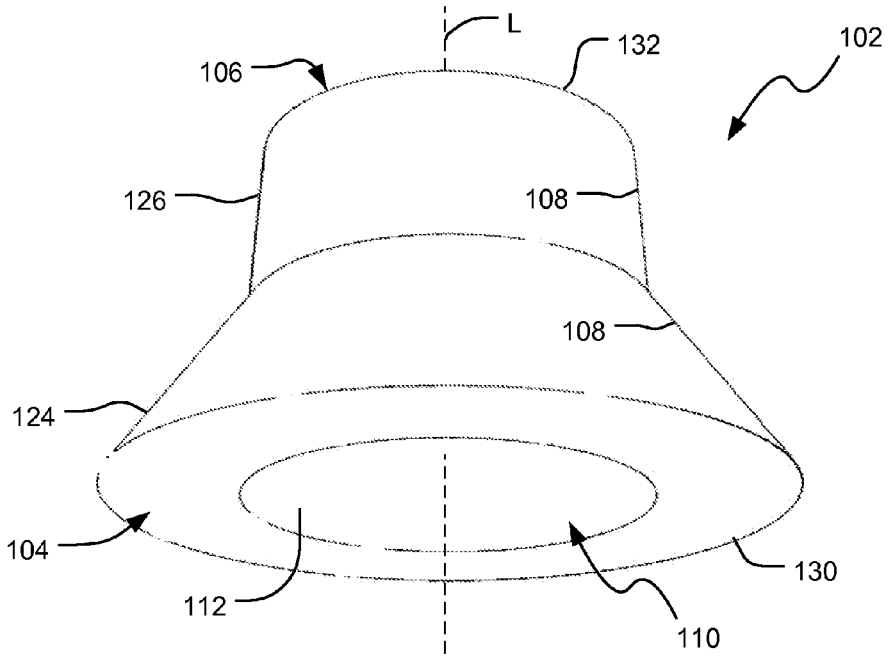
FIG. 2 is a bottom perspective drawing of the lamp optic of FIG. 1.
Figure 3:
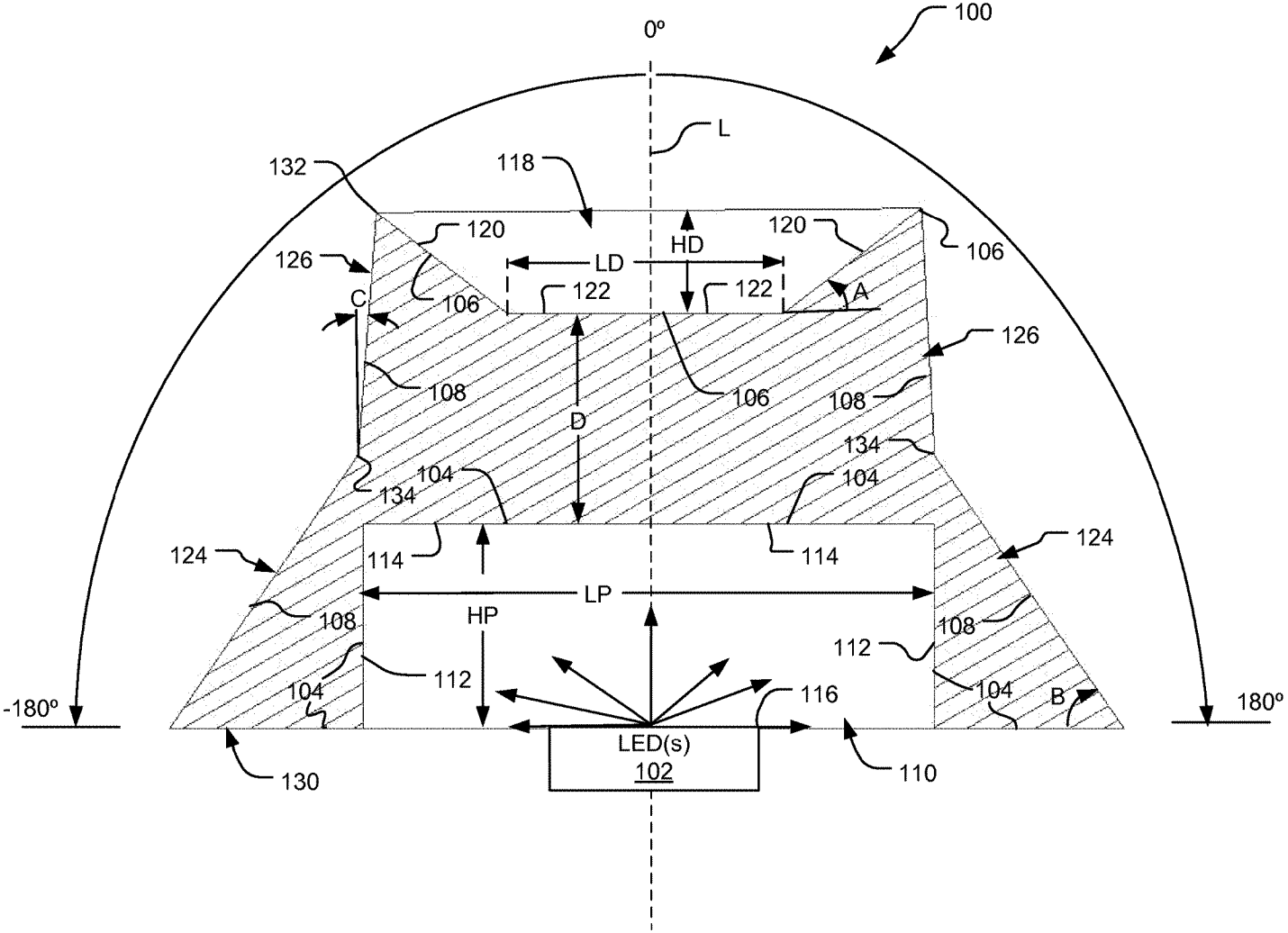
FIG. 3 is a cross-section drawing of the lamp optic of FIG. 1 and at least one LED according to an example embodiment.

FIG. 1 is a top perspective drawing and FIG. 2 is a bottom perspective drawing of a lamp optic 100 consistent with the present disclosure. FIG. 3 is a cross-sectional drawing of the lamp optic 100 shown in FIGS. 1 and 2. In an example, the lamp optic 100 is rotationally symmetric about a longitudinal axis (L) extending from a proximal end 104 to a distal end 106 of the lamp optic 100 so that features and elements of the lamp optic 100 shown in FIG. 3 are cross-sections of respective surfaces of revolution around the longitudinal axis (L). The lamp optic 100 is formed from a material that has a higher index of refraction than air and is transparent in the visible portion of the spectrum, such as polymethyl methacrylate (PMMA), silicone, etc. The lamp optic 100 may be formed from molding, grinding and polishing, or another suitable manufacturing process.

Figure 4:
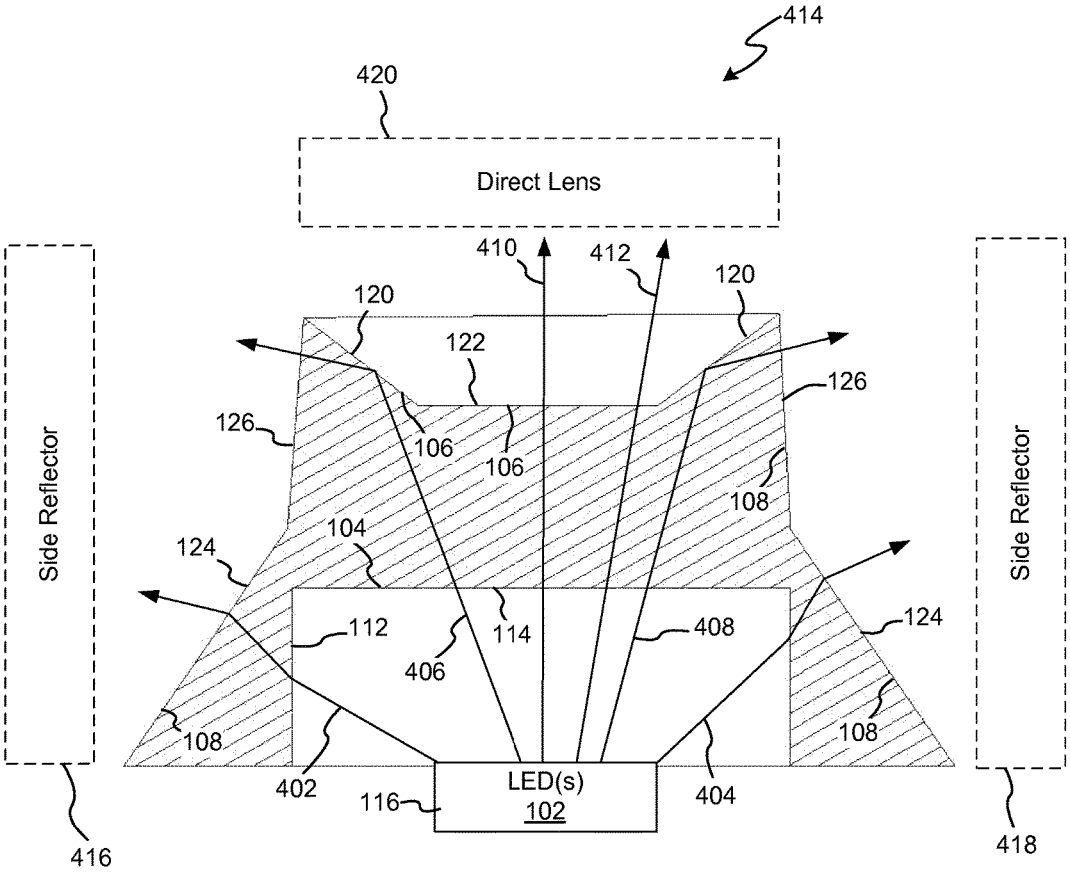
FIG. 4 is a cross-section drawing of the lamp optic of FIG. 1 showing ray traces from at least one LED according to an example embodiment.

Light is produced by one or more LED(s) 102, shown near the bottom of FIG. 3. The LED(s) 102 may be provided in many different configurations. In some examples, there may be three, four, or five LED(s) 102. The LED(s) 102 are not part of the lamp optic 100. The LED(s) 102 are distributed around and/or on the longitudinal axis (L) of the lamp optic 100. For example, in an embodiment including only a single one of the LED(s) 102, the single one of the LED(s) 102 may be centered on the longitudinal axis (L), and in an embodiment including four LED(s) 102, the four LED(s) 102 may be distributed around the longitudinal axis (L) and equidistantly from the longitudinal axis (L). Although the lamp optic 100 is shown in cross-section in FIG. 3, the LED(s) 102 shown in FIG. 3, and in subsequent FIG. 4, are illustrated for convenience as being disposed on the longitudinal axis (L), but could also be disposed in front of or behind the plane of the page of the corresponding figures.

The LED(s) 102 may include a common emission plane 116 that is perpendicular to the longitudinal axis (L). The LED(s) 102 emit light in a Lambertian distribution, which has a characteristic emission pattern that peaks along the direction of longitudinal axis (L) and decreases to zero at angles perpendicular to the longitudinal axis (L). Most of the light leaving the LED(s) 102 travels upward in FIG. 3, with a smaller amount being directed angularly toward the lateral sides of the longitudinal axis (L).

In some examples, the LED(s) 102 all emit light at the same wavelength. In some of these examples, the LED(s) 102 may be dimmable, with a wavelength spectrum that remains invariant as the intensity is varied. In other examples, at least two of the LED(s) 102 emit light at different wavelengths. In some examples, the LED(s) 102 include individual LED(s) that emit light in the red, green, and blue portions of the spectrum. For these examples, the combined light from the LED(s) 102 may simulate a specified color target, such as white light, or the light produced by a compact fluorescent lamp. For some of these examples, the light output of each of the differently colored LED(s) may be controlled independently, so that the combined light from the LED(s) 102 may be tunable to a desired color target. The tuning may be performed automatically, or may be performed manually by a user. For some of the tunable examples, the LED(s) 102 may be dimmable, with a combined wavelength spectrum that remains invariant as the combined intensity is varied.

The light from the LED(s) 102 propagates upward in FIG. 3, and enters the lamp optic 100 through the proximal end 104 of the lamp optic 100. Light propagates within the lamp optic 100, with a variety of propagation directions, toward a distal end 106 of the lamp optic 100. For some propagation directions, light travels from the proximal end 104 directly through the distal end 106. For some propagation directions, light travels from the proximal end 104, reflects from the distal end 106 and passes through the lateral side 108 of the lamp optic 100. For some propagation directions, the light travels from the proximal end 104 and exits through the lateral side 108 of the lamp optic 100 without reaching the distal end 106. The proximal end 104, the distal end 106, and the lateral side 108 all extend across a number of features and regions, which are described in detail below.

The proximal end 104 of the lamp optic 100 includes a proximal cavity 110 defined by a proximal inner side wall 112 that linearly extends toward the distal end 106 and intersects a proximal flat portion 114. In the illustrated embodiment, in a plane bisecting the lamp optic 100 and including the longitudinal axis (L) the proximal inner side wall 112 is substantially parallel to the longitudinal axis (L). The proximal inner side wall 112 has a proximal inner side wall height (HP) in a plane bisecting the lamp optic 100 and including the longitudinal axis (L). As shown, the proximal inner side wall height (HP) is measured in a direction substantially parallel to the longitudinal axis (L) from a plane defined by a proximal edge 130 of the lamp optic 100 to the proximal flat portion 114. The proximal inner side wall height (HP) may be sized to accommodate a particular portion of the propagation angles from the LED(s) 102; see, for instance, FIG. 4.

The proximal flat portion 114 extends transverse to the longitudinal axis (L) and may define a plane that is substantially parallel to the emission plane 116 of the LED(s) 102. The proximal flat portion 114 has a proximal flat portion length (LP) in a plane perpendicular to a plane bisecting the lamp optic 100 and including the longitudinal axis (L). As shown, the proximal flat portion length (LP) is measured in a direction transverse to the longitudinal axis (L) from the proximal inner side wall 112 on a first side of the longitudinal axis (L) to the proximal inner side wall 112 on an opposite side of the longitudinal axis (L). The proximal flat portion length (LP) and the ratio of the proximal flat portion length (LP) to the proximal inner side wall height (HP) may be selected sized to accommodate a particular portion of the propagation angles from the LED(s) 102; see, for instance, FIG. 4.

The proximal cavity 110 is substantially cylindrical in shape, with a center of curvature located at or near the intersection between the longitudinal axis (L) and the emission plane 116 of the LED(s) 102. The proximal cavity 110 may fully surround the half-plane emergent from the LED(s) 102 and may receive essentially all the light emitted from the LED(s) 102. The proximal end 104 of the lamp optic 100 optionally includes an anti-reflection thin-film coating. The optional anti-reflection coating may extend over the proximal inner side wall 112 and the proximal flat portion 114. Alternatively, the proximal end 104 of the lamp optic 100 may be devoid of a thin-film coating.

The distal end 106 of the lamp optic 100 includes a distal cavity 118 defined by a distal inner side wall 120 that linearly extends toward the proximal end 104 and intersects a distal flat portion 122 at an angle (A). The angle (A) is greater than 0 degrees and less than 90 degrees and in an embodiment is between about 35 degrees and 45 degrees. The distal inner side wall 120 extends linearly from the distal flat portion 122 in the distal direction (e.g., away from the LED(s) 102) at increasing distances away from the longitudinal axis (L). The distal cavity 118 is substantially frusto-conical in shape, with the most-depressed portion (e.g., the most proximal portion) being the distal flat portion 122.

The distal inner side wall 120 has a distal inner side wall height (HD) in a plane bisecting the lamp optic 100 and including the longitudinal axis (L). As shown, the distal inner side wall height (HD) is measured in a direction substantially parallel to the longitudinal axis (L) from a plane defined by a distal edge 132 of the lamp optic 100 to the distal flat portion 122. The distal inner side wall height (HD) may be sized to accommodate a particular portion of the propagation angles from the LED(s) 102; see, for instance, FIG. 4.

The distal flat portion 122 extends transverse to the longitudinal axis (L) and may define a plane that is substantially parallel to the emission plane 116 of the LED(s) 102. The distal flat portion 122 and has a distal flat portion length (LD) in a plane perpendicular to a plane bisecting the lamp optic 100 and including the longitudinal axis (L). As shown, the distal flat portion length (LD) is measured from the distal inner side wall 120 on a first side of the longitudinal axis (L) to the distal inner side wall 120 on an opposite side of the longitudinal axis (L).

The distal flat portion length (LD) is less than the proximal flat portion length (LP) and is at least twenty-five percent of the proximal flat portion length (LP). The distal flat portion length (LD) may be sized to accommodate a particular portion of the propagation angles from the LED(s) 102 and the distal inner side wall 120 may be laterally sized and may intersect the distal flat portion 122 at a selected angle (A) to accommodate another particular portion of the propagation angles from the LED(s) 102; see, for instance, FIG. 4. The distal end 106 of the lamp optic 100 may be devoid of a thin-film coating.

A distance (D) between the proximal flat portion 114 and the distal flat portion 122 may be defined in a plane perpendicular to a plane bisecting the lamp optic 100 and including the longitudinal axis (L). The distance (D) is measured substantially parallel to the longitudinal axis, as shown. The distance (D) may be selected to accommodate a particular application. In an embodiment, the distance (D) may be substantially the same as the distal flat portion length (LD).

The lateral side 108 of the lamp optic 100 extends from the proximal end 104 to the distal end 106. The lateral side 108 has a first skirt region 124 and a second skirt region 126. The first skirt region 124 and the second skirt region 126 extend linearly and successively from the proximal end 104 to the distal end 106. In a plane bisecting the lamp optic 100 and including the longitudinal axis (L), e.g. as shown in FIG. 3., the first skirt region 124 extends linearly from the proximal end 104 toward the distal end 106 (e.g., away from the LED(s) 102) at decreasing distances away from the longitudinal axis (L) at an angle (B) and meets the second skirt region at a single inflection 134 in the lateral side 108. The overall shape of the lateral side 108 in the first skirt region 124 is frusto-conical. In the plane bisecting the lamp optic 100 and including the longitudinal axis (L), e.g. as shown in FIG. 3., the second skirt region 126 extends linearly from the first skirt region 124 toward a location adjacent the distal end 106 in the distal direction (e.g., away from the LED(s) 102) at decreasing distances away from the longitudinal axis (L) at an angle (C).

The angle (B) is different from the angle (C) and both angles (B) and (C) greater than 0 degrees and less than 90 degrees. In some embodiments the angle (B) is between about 50 degrees and 60 degrees and the angle (C) is between about 2 degrees and 4 degrees. The overall shape of the lateral side 108 in the first skirt region 124 is frusto-conical and the overall shape of the lateral side 108 in the second skirt region 126 is frusto-conical. The inflection 134 in the lateral side 108 where the first skirt region 124 meets the second skirt region 126 is disposed between a plane defined by the proximal flat portion 114 and a plane defined by the distal flat portion 122.

The specific values of the proximal inner wall height (HP), the proximal flat portion length (LP), the distal inner wall height (HD), the distal flat portion length (LD), the distance (D) between the proximal flat portion 114 and the distal flat portion 122, and the angles (A), (B) and (C) may be selected depending on the application and the desired intensity and angular distribution of the light output of the lamp optic 100. In any embodiment consistent with the present disclosure, the distal flat portion length (LD) should be less than the proximal flat portion length (LP) and at least 25 percent of the proximal flat portion length (LP). In an embodiment, the distal flat portion length (LD) may be about 50 percent of the proximal flat portion length (LP), the distance (D) between the proximal flat portion 114 and the distal flat portion 122 may be substantially the same as the distal flat portion length (LD), the proximal inner wall height (HP) may be about 40 percent of the proximal flat portion length (LP), the distal inner wall height (HD) may be about 40 percent of the distal flat portion length (LD), the angle (A) may be about 55 degrees, the angle (B) may be about 37 degrees and the angle (C) may be about 3 degrees.

In general the lamp optic 100 is shaped so that for relatively low angles of propagation away from the LED(s) 102 light that strikes the proximal inner side wall 112 passes through the proximal inner side wall 112 and is emitted from the first skirt region 124. Some of the light that strikes the proximal flat portion 114 passes through the proximal flat portion 114, is reflected by the distal inner side wall 120 and emitted from the second skirt region 126. Some of the light that strikes the proximal flat portion 114 passes through the proximal flat portion 114 and is emitted from the distal flat portion 122.

This behavior is shown in more detail in FIG. 4. During operation, light emerges from the emission plane 116 of the LED(s) 102 with a full angular bundle of rays that extend over a full half-plane. Different portions of the light from the LED(s) 102 pass through different portions of the lamp optic 100. FIG. 4 schematically illustrates ray traces 402, 404, 406, 408, 410, 412 of light rays inside the lamp optic 100 for different portions of the light from the LED(s) 102. It is beneficial to analyze separately these different portions of the light from the LED(s) 102, keeping in mind that during operation, the light form the LED(s) 102 exhibits all of these behaviors simultaneously.

In FIG. 4 the traces 402 and 404 illustrate the behavior of one group of light rays propagating from the LED(s) 102, and through the lamp optic 100. This particular group of rays is referred to as a first portion of the light from the LED(s) 102. As shown, the lamp optic 100 is configured to receive the first portion of light from the LED(s) 102 through the proximal inner side wall 112 of the proximal end 104 and emit the first portion of the light from the first skirt region 124 of the lateral side 108.

The traces 406 and 408 illustrate the behavior of a second group of light rays propagating from the LED(s) 102, and through the lamp optic 100. This particular group of rays is referred to as a second portion of the light from the LED (s) 102. As shown, the lamp optic 100 is configured to receive the second portion of the light from the LED(s) 102 through the proximal flat portion 114 of the proximal end 104, guide the second portion to be reflected by the distal inner side wall 120 of the distal end 106 and emit the second portion from the second skirt region 126 of the lateral side 108.

The traces 410 and 412 illustrate the behavior of a third group of light rays propagating from the LED(s) 102, and through the lamp optic 100. This particular group of rays is referred to as a third portion of the light from the LED (s) 102. As shown, the lamp optic 100 is configured to receive the third portion of the light from the LED(s) 102 through the proximal flat portion 114 of the proximal end 104 and emit the third portion from the distal flat portion 122 of the distal end 106.

A lamp optic consistent with the present disclosure thus emits light through the first skirt region 124 of the lateral side 108, the second skirt region 126 of the lateral side 108 and the distal flat portion 122. Advantageously, this allows use of the lamp optic in a lamp assembly 414 that optionally includes one or more side reflectors 416, 418 and/or a direct lens 420, such as a Fresnel lens. Providing a distal flat portion 122 having a distal flat portion length (LD) less than, and at least twenty-five percent of, the proximal flat portion length (LP) of the proximal flat portion 114 establishes a sufficient forwardly-directed light output emitted from the distal flat portion 122 to allow use of the lamp optic 100 in application incorporating a direct lens 420, while allowing a sufficient sidewardly-directed output from the first skirt region 124 and second skirt region 126 of the lateral side 108 to allow use of the lamp optic 100 in applications incorporating one or more side reflectors 416, 418. In contrast, known lamps optics fail to emit sufficient forwardly and sidewardly-directed light to allow use of the lamp optic with direct lenses 420 and side reflectors 416, 418. The present lamp optic 100 therefore achieves a significant improvement in performance over known lamp optics.

Figure 5:
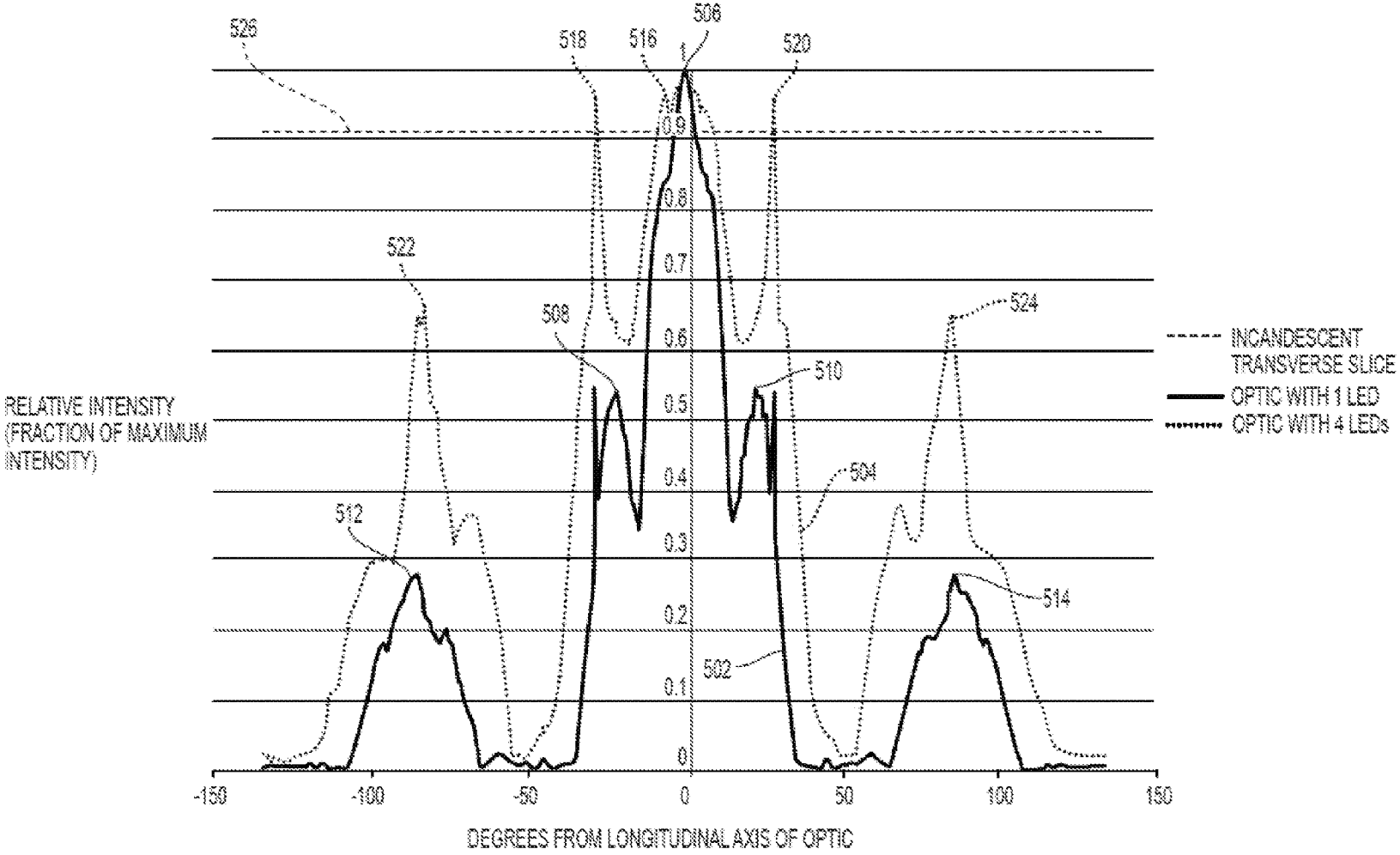
FIG. 5 includes plots of simulated relative intensity vs. angle from a longitudinal axis illustrating operation of example embodiments of lamp optics.

FIG. 5 includes plots 502, 504 of simulated relative intensity (as a fraction of maximum intensity) vs. angle (degrees) from the longitudinal axis (L) of a computer-modeled lamp optic 100 consistent with the present disclosure. Plots 502 and 504 illustrate relative intensity in a plane bisecting a lamp optic 100 and including the longitudinal axis (L). As illustrated for example in FIG. 3, the angle 0 degrees in plots 502 and 504 indicates a direction along the longitudinal axis (L) of an optic 100 consistent with the present disclosure. Increasing angles in plots 502 and 504 indicates rotation away from the longitudinal axis (L) and pivoting at the intersection of the longitudinal axis (L) and the emission plane 116 of the LED(s) 102 to 180 degrees to the right of the page in FIGS. 3 and to −180 degrees to the left of the page in in FIG. 3.

Plot 502 illustrates relative intensity vs. angle from the longitudinal axis (L) of a lamp optic 100 when the LED(s) 102 include only a single LED centered on the longitudinal axis (L) of the lamp optic 100. As shown in plot 502, the light output of a lamp optic 100 consistent with the present disclosure including a single one of the LED(s) 102 has a central peak 506, first side peaks 508, 510 and second side peaks 512, 514. In plot 502 the intensity of the first side peaks 508, 510 is lower than the intensity of the central peak 506 and the intensity of second side peaks 512, 514 is lower than the intensity of the central peak 506 and lower than the intensity of the first side peaks 508, 510. Also, the intensity of the first side peaks 508, 510 is greater than 50 percent of the intensity of the central peak 506 and the intensity of second side peaks 512, 514 is greater than 20 percent of the intensity of the central peak 506.

Plot 504 illustrates relative intensity vs. angle from the longitudinal axis of a lamp optic 100 wherein the LED(s) 102 include four separate LED(s) positioned around the longitudinal axis (L) of the optic 100 and equidistant from the longitudinal axis (L) of the optic 100. As shown in plot 504, the light output of a lamp optic 100 consistent with the present disclosure including four LED(s) 102 has a central peak 516, first side peaks 518, 520 and second side peaks 522, 524. In plot 504 the intensity of the second side peaks 522, 524 is lower than the intensity of the central peak 516 and lower than the intensity of the first side peaks 518, 520. Also, the intensity of the first side peaks 518, 520 is greater than 90 percent of the intensity of the central peak 516 and the intensity of second side peaks 522, 524 is greater than 60 percent of the intensity of the central peak 516.

In general, and with reference to FIG. 5, a lamp optic 100 consistent with the present disclosure advantageously exhibits light output having a central peak (e.g. 506, 516) at an angle between plus and minus 15 degrees from the longitudinal axis (L), first side peaks (e.g. 508, 510 or 518, 520) at angles between plus 20 and plus 40 degrees and between minus 20 and minus 40 degrees, respectively, from the longitudinal axis (L), and second side peaks (e.g. 512, 514 or 522, 524) at angles between plus 70 and plus 110 degrees and between minus 70 and minus 110 degrees, respectively, from the longitudinal axis (L). For example, in one simulated embodiment using four OSLON Black Flat LR H9PP LEDs (which are commercially available from Osram GmbH) positioned around the longitudinal axis (L) and equidistant from the longitudinal axis (L), each of the LED(s) provided an output 40 lumens (lm) and the lamp optic 100 emits light having a central peak at an angle of 0 degrees with an intensity of about 47 candela (cd), first side peaks at angles of about plus and minus 23 degrees with an intensity of about 38 (cd) and second side peaks at angles of about plus and minus 84 degrees with an intensity of about 30 (cd).

For comparison, plot 526 illustrates an approximation of a simulated relative intensity vs. angle from the longitudinal axis of a prior art incandescent lamp. Plot 526 illustrates relative intensity in a plane bisecting the incandescent lamp and perpendicular to a longitudinal axis of a coil of the incandescent lamp, i.e. transverse to the coil of the incandescent lamp. As shown, an lamp optic 100 consistent with the present disclosure (plots 502, 504) provides an output intensity at a central peak (e.g. 506, 516) that may match the intensity of an incandescent lamp (plot 526) to facilitate use of the lamp optic 100 in applications including a direct lens 420 (FIG. 4), while also providing first side peaks (e.g. 508, 510 or 518, 520) and second side peaks (e.g. 512, 514 or 522, 524) to facilitate use of the lamp optic 100 in applications including one or more side reflector lenses 416, 418.

Figure 6:
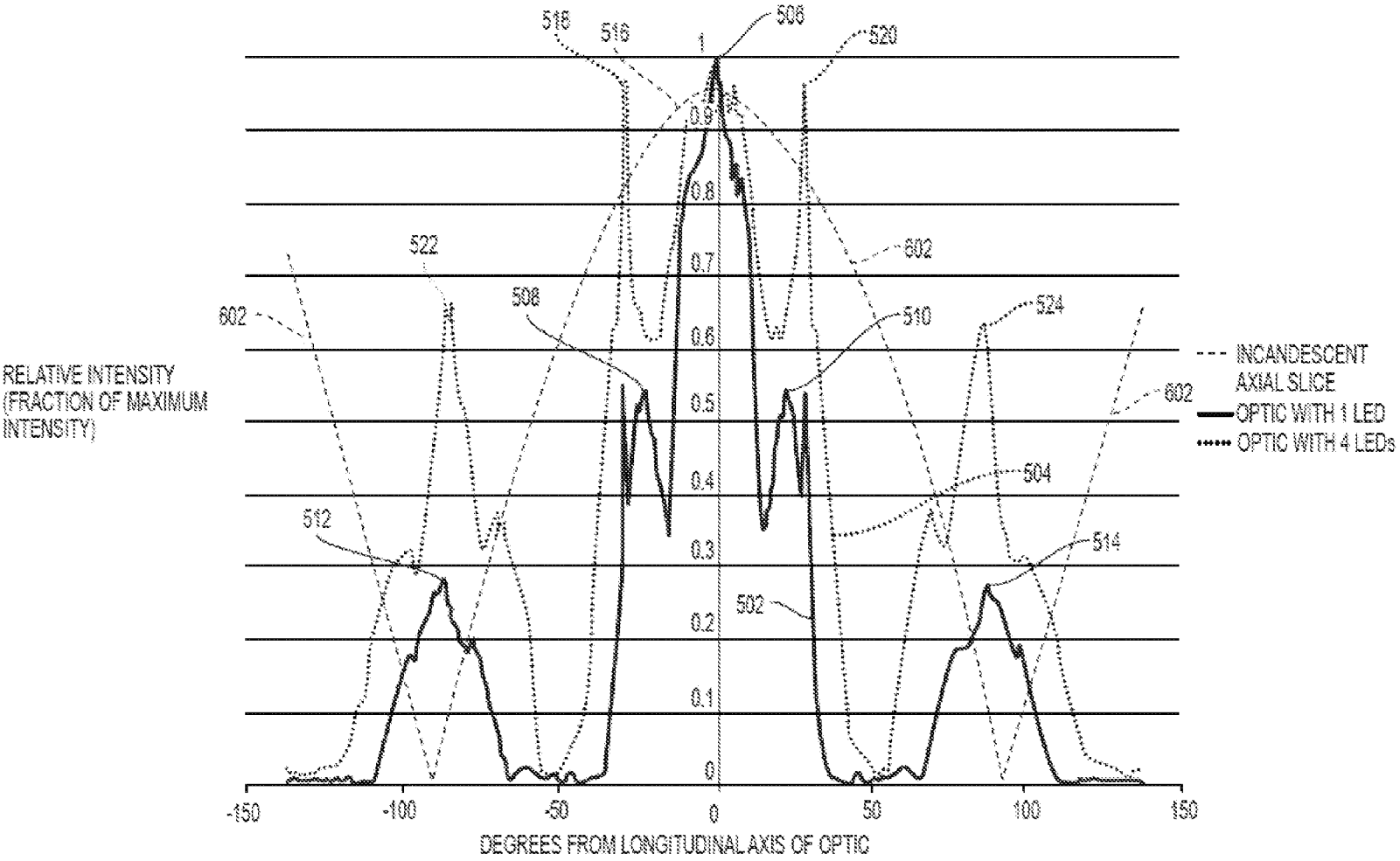
FIG. 6 includes plots of simulated relative intensity vs. angle from a longitudinal axis illustrating operation of example embodiments of lamp optics.

FIG. 6 includes plots 502, 504 of simulated relative intensity (as a fraction of maximum intensity) vs. angle (degrees) from the longitudinal axis (L) of an optic 100 consistent with the present disclosure, as described in above with regard to FIG. 5, and, for comparison, includes a plot 602 of simulated relative intensity vs. angle from the longitudinal axis of a prior art incandescent lamp. Plot 602 illustrates an approximation of a simulated relative intensity in a plane bisecting the incandescent lamp and including the longitudinal axis of a coil of the incandescent lamp, i.e. axially to the coil of the incandescent lamp. As shown, a lamp optic 100 consistent with the present disclosure (plots 502, 504) provides an output intensity at a central peak (e.g. 506, 516) that may match the intensity of an incandescent lamp (plot 602) to facilitate use of the lamp optic 100 in applications including a direct lens 420 (FIG. 4), while also providing first side peaks (e.g. 508, 510 or 518, 520) and second side peaks (e.g. 512, 514 or 522, 524) to facilitate use of the lamp optic 100 in applications including one or more side reflectors 416, 418 (FIG. 4).

Figure 7:
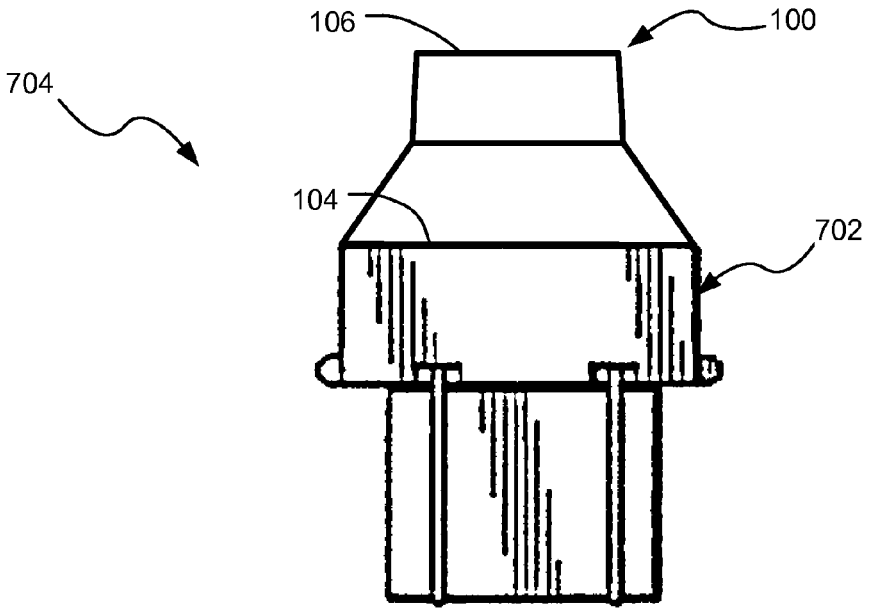
FIG. 7 is side view drawing of a lamp optic according to an embodiment combined with a wedge-type automotive base.
Figure 8:
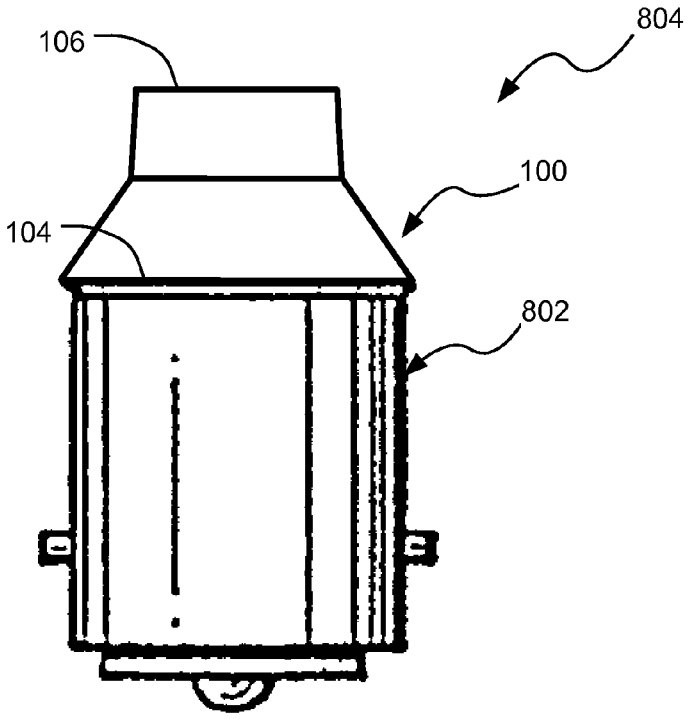
FIG. 8 is side view drawing of a lamp optic according to an embodiment combined with a bayonet-type automotive base.

A lamp optic 100 consistent with the present disclosure is useful in automotive applications and may be combined with an automotive base to establish an automotive lamp assembly. Several different types of automotive bases are known. In general, an automotive base is configured to mate with a mating connector, e.g. a receptacle, for coupling a vehicle power source to a light source coupled to the automotive base. FIG. 7 illustrates one example embodiment wherein a lamp optic 100 consistent with the present disclosure is combined with a conventional wedge-type automotive base 702 to form an automotive lamp assembly 704. FIG. 8 illustrates an example embodiment wherein a lamp optic 100 consistent with the present disclosure is combined with a conventional bayonet-type automotive base 802 to form an automotive lamp assembly 804. The lamp optic 100 may be coupled to the automotive base 702, 802, e.g. by interference fit, adhesive, etc. with the LED(s) 102 (FIG. 3) disposed between the proximal end 104 of the lamp optic 100 and the automotive base 702, 802,. The automotive bases 702, 802 are configured to couple a vehicle power source to the LED(s) 102 (FIG. 3) to thereby cause emission of light from the LEDs(s) 102 (FIG. 3).

The description of the invention and its applications as set forth herein is illustrative and is not intended to limit the scope of the invention. Variations and modifications of the embodiments disclosed herein are possible, and practical alternatives to and equivalents of the various elements of the embodiments would be understood to those of ordinary skill in the art upon study of this patent document. These and other variations and modifications of the embodiments disclosed herein may be made without departing from the scope and spirit of the invention.

GLOSSARY: A NON-LIMITING SUMMARY OF ABOVE REFERENCE NUMERALS

100 lamp optic
102 LED(s)
104 proximal end
106 distal end
108 lateral side
110 proximal cavity
112 side wall
114 proximal flat portion
116 emission plane
118 distal cavity
120 distal inner side wall
122 distal flat portion
124 first skirt region
126 second skirt region
130 proximal edge
132 distal edge
134 single inflection
402 ray trace
404 ray trace
406 ray trace
408 ray trace
410 ray trace
412 ray trace
414 lamp assembly
416 side reflector lens
418 side reflector lens
420 direct lens
502 plots
504 plots
506 central peak
508 first side peak
510 first side peak
512 second side peak
514 second side peak
516 central peak
518 first side peak
520 first side peak
522 second side peak
524 second side peak
702 wedge-type automotive base
704 automotive lamp assembly
802 bayonet-type automotive base
804 automotive lamp assembly
A angle
B angle
C angle
D distance
HD distal inner side wall height
HP proximal inner side wall height
L longitudinal axis
LD distal flat portion length
LP proximal flat portion length

What is claimed is:

1. A lamp optic (100), comprising:

a proximal end (104), a distal end (106) and a longitudinal axis (L) extending from the proximal end (104) to the distal end (106);

the proximal end (104) being configured to receive light from at least one light emitting diode (102), the proximal end (104) having a proximal inner side wall (112) linearly extending toward the distal end (106) and intersecting a proximal flat portion (114), the proximal flat portion (114) extending transverse to the longitudinal axis (L) and having a proximal flat portion length (LP) in a plane perpendicular to a plane bisecting the lamp optic (100) and including the longitudinal axis (L), the proximal flat portion length (LP) measured from the proximal inner side wall (112) on a first side of the longitudinal axis (L) to the proximal inner side wall (112) on an opposite side of the longitudinal axis (L);

the distal end (106) having a distal inner side wall (120) linearly extending toward the proximal end (104) and intersecting a distal flat portion (122), the distal flat portion (122) extending transverse to the longitudinal axis (L), the distal flat portion (122) having a distal flat portion length (LD) in the plane perpendicular to a plane bisecting the lamp optic (100) and including the longitudinal axis (L), the distal flat portion length (LD) measured from the distal inner side wall (120) on a first side of the longitudinal axis (L) to the distal inner side wall (120) on an opposite side of the longitudinal axis (L);

the distal flat portion length (LD) being at least 25 percent of the proximal flat portion length (LP); and a lateral side (108) extending from the proximal end (104) to the distal end (106), the lateral side (108) having a first skirt region (124) and a second skirt region (126), the first skirt region (124) and the second skirt region (126) extending linearly and successively from the proximal end (104) to the distal end (106);

whereby the lamp optic (100) is configured to receive a first portion of light from the at least one light emitting diode (102) through the proximal inner side wall (112) of the proximal end (104) and emit the first portion of the light from the first skirt region (124) of the lateral side (108), and whereby the lamp optic (100) is configured to receive a second portion of the light from the at least one light emitting diode (102) through the proximal flat portion (114) of the proximal end (104), guide the second portion of the light to be reflected by the distal inner side wall (120) of the distal end (106) and emit the second portion of the light from the second skirt region (126) of the lateral side (108), and whereby the lamp optic (100) is configured to receive a third portion of the light from the at least one light emitting diode (102) through the proximal flat portion (114) of the proximal end (104) and emit the third portion of the light from the distal flat portion (122) of the distal end (106).

2. The lamp optic (100) of claim 1, whereby in a plane bisecting the lamp optic (100) and including the longitudinal axis (L) the proximal inner side wall (112) is substantially parallel to the longitudinal axis (L).

3. The lamp optic (100) of claim 1, wherein the proximal inner side wall (112) and the proximal flat portion (114) define a substantially cylindrical proximal cavity (110).

4. The lamp optic (100) of claim 1, wherein the proximal flat portion (114) defines a plane substantially parallel to an emission plane (116) of the at least one light emitting diode (102).

5. The lamp optic (100) of claim 1, whereby in a plane bisecting the lamp optic (100) and including the longitudinal axis (L) the distal inner side wall (120) intersects the distal flat portion (122) at an angle (A) of less than ninety degrees.

6. The lamp optic (100) of claim 1, wherein the distal inner side wall (120) and the distal flat portion (122) define a substantially frusto-conical distal cavity (118).

7. The lamp optic (100) of claim 1, wherein the distal flat portion (122) defines a plane substantially parallel to an emission plane (116) of the at least one light emitting diode (102).

8. The lamp optic (100) of claim 1, whereby in a plane bisecting the lamp optic (100) and including the longitudinal axis (L) the first skirt region (124) extends linearly from the proximal end (104) toward the distal end (106) at decreasing distances away from the longitudinal axis (L) at a first angle (B), and the second skirt region (126) extends linearly from the first skirt region (124) toward a the distal end (106) at decreasing distances away from the longitudinal axis (L) at second angle (C).

9. The lamp optic (100) of claim 1, whereby in a plane bisecting the lamp optic (100) and including the longitudinal axis (L) the light output of the lamp optic (100) has a central peak at an angle between plus and minus 15 degrees from the longitudinal axis (L) in the plane, first side peaks at angles between plus 20 and plus 40 degrees and between minus 20 and minus 40 degrees, respectively, from the longitudinal axis (L) in the plane, and second side peaks at angles between plus 70 and plus 110 degrees and between minus 70 and minus 110 degrees, respectively, from the longitudinal axis (L) in the plane.

10. The lamp optic (100) of claim 1, whereby in a plane bisecting the lamp optic (100) and including the longitudinal axis (L) the light output of the lamp optic (100) has a central peak at an angle between plus and minus 15 degrees from the longitudinal axis (L) in the plane and at least first side peaks at angles between plus 20 and plus 40 degrees and between minus 20 and minus 40 degrees, respectively, from the longitudinal axis (L) in the plane, wherein the intensity of the first side peaks is lower than the intensity of the central peak but greater than 50 percent of the intensity of the central peak.

11. The lamp optic (100) of claim 1, wherein the lamp optic (100) is rotationally symmetric about the longitudinal axis (L).

12. The lamp optic (100) of claim 1 in combination with an automotive base (402) configured for coupling an electrical power source (404) to the at least one light emitting diode (102).

13. The lamp optic (100) of claim 5, wherein the angle (A) is between about 35 degrees and 45 degrees.

14. The lamp optic (100) of claim 8, wherein the first angle (B) is between about 50 degrees and 60 degrees and the second angle (C) between about 2 degrees and 4 degrees.

15. The lamp optic (100) of claim 9, wherein the intensity of the second side peaks is lower than the intensity of the central peak and lower than the intensity of the first side peaks.

16. The lamp optic (100) of claim 9, wherein the intensity of the first side peaks is lower than the intensity of the central peak but greater than 50 percent of the intensity of the central peak and the intensity of second side peaks is lower than the intensity of the central peak but greater than 20 percent of the intensity of the central peak.

17. The lamp optic (100) of claim 9, wherein the intensity of the second side peaks is at least thirty candela when the at least one light emitting diode (102) comprises four light emitting diodes, each of the four light emitting diodes providing an output of about 40 lumens.

* * * * *